United States Patent [19]

Hamel

[11] 4,070,818

[45] Jan. 31, 1978

[54] METHOD OF MAKING A CORE YARN

[75] Inventor: Edmund Hamel, Romanshorn, Switzerland

[73] Assignee: Ofa AG, Horn, Switzerland

[21] Appl. No.: 741,119

[22] Filed: Nov. 11, 1976

Related U.S. Application Data

[62] Division of Ser. No. 620,789, Oct. 8, 1975.

[30] Foreign Application Priority Data

Apr. 2, 1975 Germany ..... 2514302

[51] Int. Cl.[2] ..... D02G 3/38

[52] U.S. Cl. ..... 57/160; 57/144

[58] Field of Search ..... 57/160, 163, 24, 144

[56] References Cited

U.S. PATENT DOCUMENTS

| | | | |
|---|---|---|---|
| 347,538 | 8/1886 | Waring | 57/24 |
| 2,902,820 | 9/1959 | Bronson et al. | 57/163 |
| 3,070,950 | 1/1963 | Thomas | 57/163 X |
| 3,715,878 | 2/1973 | Kim | 57/24 X |

*Primary Examiner*—Richard C. Queisser
*Assistant Examiner*—Charles Gorenstein
*Attorney, Agent, or Firm*—Karl F. Ross

[57] ABSTRACT

A slubbing is formed into a thin band by a plurality of pairs of rollers. A core filament is thereafter applied to each face of this band and the two core filaments and band are then spun together to form a core yarn comprising a coherent mass of fibers in which is imbedded a pair of parallel and spaced apart core filaments with some of the fibers of the mass between the spaced-apart filaments.

3 Claims, 6 Drawing Figures

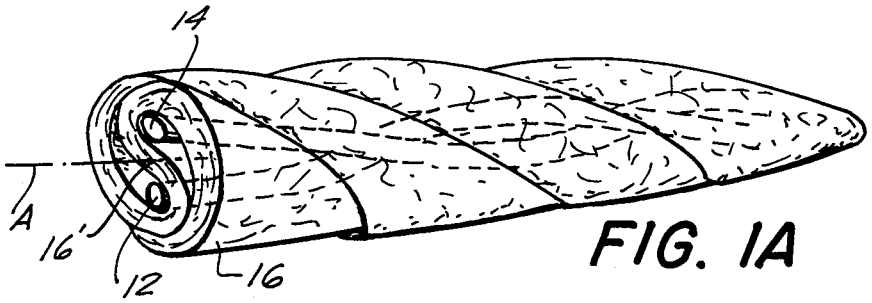
FIG. 1A
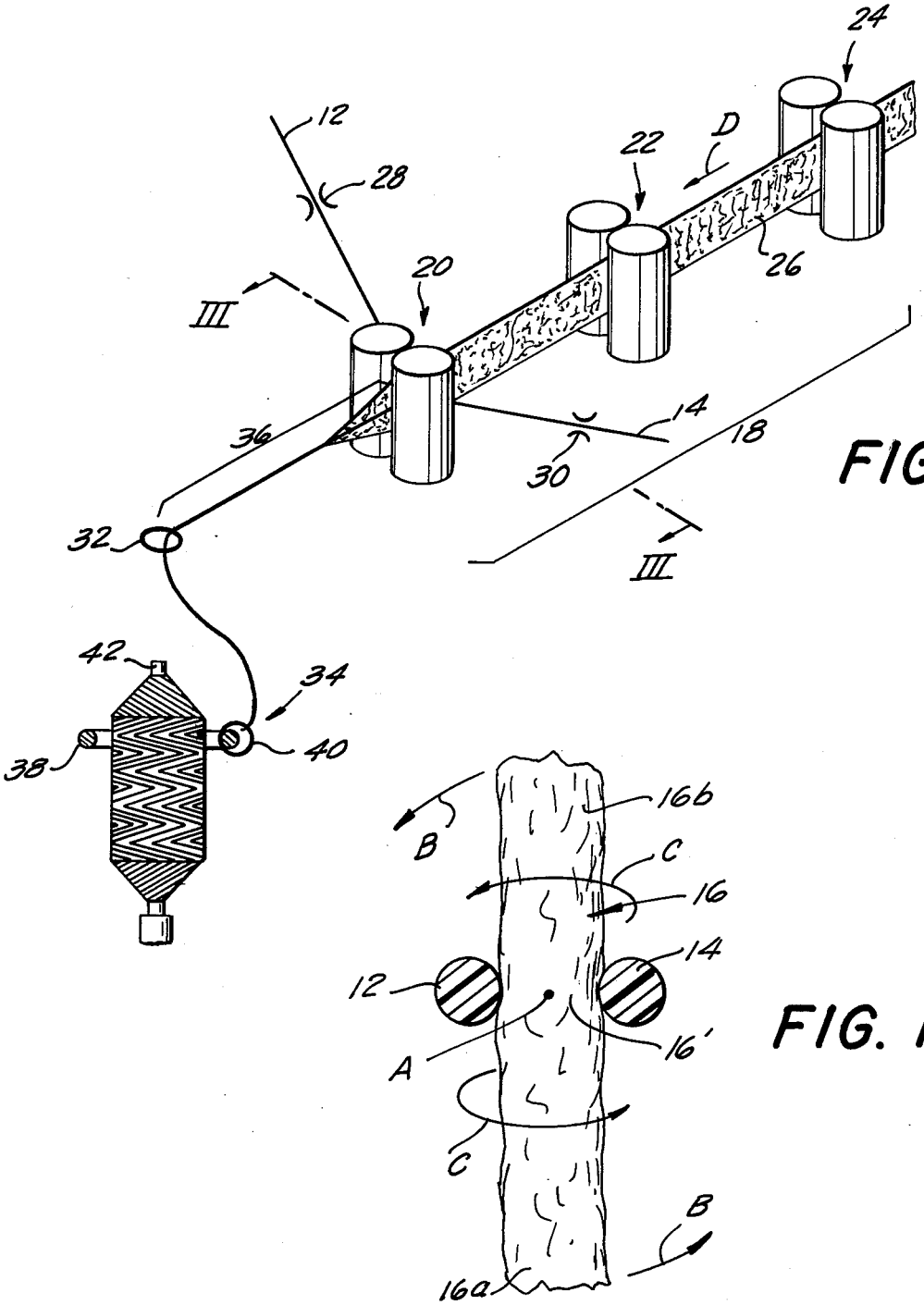
FIG. 2
FIG. 1B

METHOD OF MAKING A CORE YARN

CROSS-REFERENCE TO RELATED APPLICATION

This application is a division of Ser. No. 620,789 filed Oct. 8, 1975.

FIELD OF THE INVENTION

The present invention relates to a method of making a core yarn and, more particularly, a yarn having two core filaments and a mass of a fleece-type fibers completely surrounding these core filaments.

BACKGROUND OF THE INVENTION

A core yarn is known having a relatively strong core filament surrounded by a soft mass of fibers. Such a yarn is very soft yet at the same time has considerable longitudinal strength derived from the strong core filament.

The disadvantage of such a yarn is that very frequently the fiber covering separates from the core. Furthermore the core filament is frequently eccentric to the yarn so that after only a small amount of wear this core filament is exposed.

OBJECTS OF THE INVENTION

It is therefore an object to provide an improved method of making a core yarn.

Another object is to provide a method such that the core filaments are roughly centered within the yarn and wherein the covering does not tend to separate from the core filament.

SUMMARY OF THE INVENTION

These objects are obtained according to the present invention in a yarn having a pair of such core filaments spaced apart within a fiber mass with a portion of this mass constituting the covering between the two or more core filaments.

With such a system the fiber mass is securely held by the core filaments especially when the core filaments are spun together around the mass between them. Thus separation of the fiber covering from the core filaments is almost ruled out. The strength and resistance to wear of such a yarn is substantially greater than that of the prior-art core yarns.

The yarn according to the present invention is made clamping a pair of core filaments against opposite sides of a flat fiber slubbing or between a pair of rollers and spinning the resulting fleece assembly. The core filaments are fed to a combining station spaced apart from each other and there united with the slubbing so that some of the slubbing is always between the two filaments. This is effected in accordance with the present invention by forming the slubbing into a thin band, then applying the filaments to opposite sides of the band, and thereupon spinning together the band and slubbing so that the filaments remain separated by at least a thickness of fiber equal to the thickness of the slubbing band. The fleece or slubbing thus is wound around the filaments while the latter are twisted with the fleece between them, about a common axis. The fibers of overlapped portions of the fleece intertwine so that the overlapped portions merge together.

The filaments in accordance with this invention may be fed to the combining station directly opposite one another on opposite sides of the slubbing band, that is both lying in a plane of symmetry (constituting a plane perpendicular to the axes of the rollers) perpendicular to the plane of the band. It is also within the scope of the present invention to feed these filaments to the combining rollers parallel to each other but spaced apart (offset) on opposite sides of the slubbing band from a plane perpendicular to this band, i.e. a plane perpendicular to the axes of the rollers.

BRIEF DESCRIPTION OF THE DRAWING

The above and other objects, features, and advantages of the invention will become more readily apparent from the following description, reference being made to the accompanying drawing in which:

FIG. 1A is a perspective view showing the results of the spinning step;

FIG. 1B is a detail view diagramming the spinning action.

FIG. 2 is a partly diagrammatic perspective view showing a system for making the yarn according to this invention;

SPECIFIC DESCRIPTION

Figure 1:
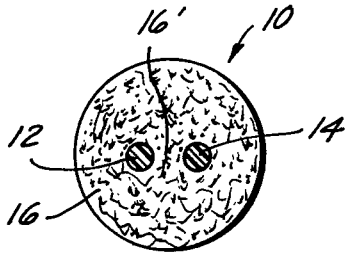
FIG. 1 is a cross-section in enlarged scale through a yarn according to this invention.

A core-type yarn 10 is shown in FIG. 1. It comprises a coherent mass 16 formed of fibers such as wool, cotton, rayon, or staple fiber, in which is imbedded a pair of like and spaced-apart filaments 12 and 14 of high-strength synthetic-resin material such as polyester. The mass 16 has a cross-sectional area that is a multiple of that of the filaments 12 and 14. The filaments 12 and 14 can be monofilaments or a tightly wound thread but in any case have a longitudinal strength which is considerably greater than the longitudinal strength of the coherent mass 16. These filaments 12 and 14 are spaced from each other with a portion 16' of the mass 16 between them.

Figure 3:
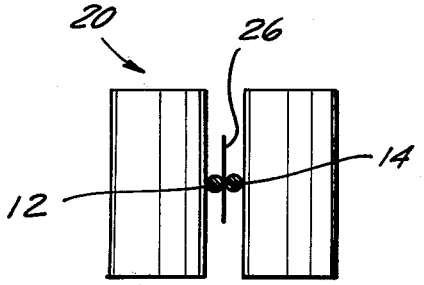
FIG. 3 is a section taken along line III — III of FIG. 2.

As shown in FIGS. 2 and 3 this yarn 10 is made in an apparatus having a former 18 constituted by three aligned pairs 20, 22 and 24 of cylindrical rollers which advance a band 26 of slubbing in a direction D. The rollers 20 rotate faster than the rollers 22 which in turn rotate faster than the rollers 24 so that the slubbing 26 is formed into a thin upright band as illustrated in FIG. 3. A pair of guides 28 and 30 feed in the filaments 12 and 14, respectively, to the combining station formed by the rollers 20. FIG. 3 illustrates how these filaments 12 and 14 are fed to opposite sides of the band 26 directly across from each other and both lying in a plane perpendicular to the plane of the band 26 of the combining station.

In a region 36 between the combining rollers 20 and an eye 32, the slubbing band 26 and filaments 12 and 14 are spun together and then wound up on a ring-type spinner 34 having a spool 42 that is rotated at high speed with the yarn to be spun passing through a traveler 40 on a ring 38 surrounding the spool 42 as described on pages 376 and 377 of *The Way Things Work* (Simon and Schuster: 1967).

Figure 4:
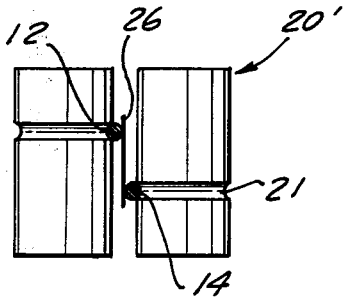
FIG. 4 is a section similar to FIG. 3 illustrating another method of making the yarn according to this invention.

It is also possible as shown in FIG. 4 to feed the two filaments 12 and 14 to opposite sides of the band 26 at rollers 20' at the downstream end of the slubbing shaper arrangement 18, with the filaments 12 and 14 being positioned offset from each other on opposite sides of the band 26. This may be effected by forming the rollers 20' with grooves 21 offset from a plane perpendicular to the band 26. Even with this system it is noted that a portion 16' of the mass 16 in the finished yarn will always lie between the two filaments 12 and 14.

As can be seen from FIG. 1B, during the spinning operation the upper and lower portions **16*b* and 16*a* of the fleece rotate about the axis A (arrows B) while the filaments 12 and 14 are simultaneously twisted (arrows C) therearound. The overlapped portions of the fleece (FIG. 1A) have their fibers intertwine so that the ultimate cross-section is that shown in FIG. 1**.

I claim:

1. A method of making a core yarn comprising the steps of:

forming a coherent flat band of wool, cotton, rayon or staple fiber from a fleece slubbing by flattening the same by passing the slubbing through a plurality of pairs of rollers, feeding said coherent elongated flat band of slubbing to a combining station, simultaneously feeding a pair of synthetic-resin core filaments in spaced-apart relationship to said station, pressing said filaments against opposite flanks of said slubbing at said station between a pair of rollers with a portion of said slubbing between said filaments, and thereafter spinning the filaments and slubbing together about a common axis while maintaining the thickness of said band between the filaments, said band having a width relative to the diameters of said core filaments such that portions of the band overlap around said filaments and have intertwined fibers at the overlapping portion upon spinning.

2. The method defined in claim 1 wherein said filaments are positioned both in a common plane perpendicular to said band at said station.

3. The method defined in claim 1 wherein said filaments are positioned on opposite sides of said bands offset to a median plane through said band perpendicular to said band.

* * * * *